US006858043B2

(12) United States Patent
Shingai et al.

(10) Patent No.: US 6,858,043 B2
(45) Date of Patent: Feb. 22, 2005

(54) FINISH FOR SYNTHETIC FILAMENT TO BE FRICTION-TEXTURED

(75) Inventors: Yo Shingai, Yao (JP); Ikuya Ujino, Yao (JP); Hirohumi Ishida, Yao (JP); Tatsuo Harada, Yao (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 369 days.

(21) Appl. No.: 10/147,852

(22) Filed: May 20, 2002

(65) Prior Publication Data

US 2003/0213068 A1 Nov. 20, 2003

(51) Int. Cl.[7] ..... D06M 13/17; D06M 13/248; D06N 13/256

(52) U.S. Cl. ..... 8/115.61; 8/115.6; 8/115.54; 8/115.56; 8/115.57; 8/115.64; 252/8.84

(58) Field of Search ..... 8/115.6, 115.61, 8/115.54, 115.56, 115.57, 115.64; 252/8.84

(56) References Cited

U.S. PATENT DOCUMENTS 5,263,308 A * 11/1993 Lee et al. ..... 57/241
6,537,662 B1 * 3/2003 Kamrath et al. ..... 428/375

FOREIGN PATENT DOCUMENTS

| | | |
|---|---|---|
| JP | 62-25789 B2 | 6/1987 |
| JP | 7-6134 B2 | 1/1995 |
| JP | 30-86153 B2 | 9/2000 |

OTHER PUBLICATIONS

Derwent abstract of JP 07006134 Be Jan. 30, 1995.*
Derwent abstract of JP 3086153 Sep. 11, 2000.*
Derwent abtract of JP 62025789 Jun. 4, 1987.*

* cited by examiner

*Primary Examiner*—Margaret Einsmann
(74) *Attorney, Agent, or Firm*—Foley & Lardner LLP

(57) ABSTRACT

A finish for synthetic filament to be processed in friction-texturing, which is applicable to various yarns and in a wide range of texturing speed, having been considered as difficult finish application field, such as low-speed friction texturing (with contact heaters), high-speed friction texturing (with non-contact heaters), coarse denier yarns and fine denier yarns, with satisfactory POY package buildup and POY release from packages, minimum fluffs and loops of POY, and with minimum fluffs of DTY and minimum fume and stain on heaters in texturing; and which contains 50 to 85 weight percent of Component A and 10 to 30 weight percent of Component B, having the following structures and a total ranging from 60 to 95 weight percent:

Component A having a structure of $R_1[O(C_2H_4O)x.(C_3H_6O)yH]z$, wherein $R_1$ is a trihydric or tetrahydric alcohol residue, z is an integer of 3 or 4 corresponding to the number of hydroxyl groups in $R_1$, and x and y are integers of 1 or greater attaining a weight ratio of oxytehylene group and oxypropylene group from 90:10 to 60:40 and a molecular weight of the resultant compound from 1000 to 4000; and Component B having a structure of $R_2[O(C_2H_4O)a.(C_3H_6O)b]COR_3$, wherein $R_2$ is a $C_{4-18}$ monohydric alcohol residue, $R_3$ is a $C_{7-17}$ fatty acid residue, a is an integer from 3 to 15, b is an integer from 0 to 12 and the total of a and b ranges from 6 to 15.

2 Claims, No Drawings

FINISH FOR SYNTHETIC FILAMENT TO BE FRICTION-TEXTURED

BACKGROUND OF THE INVENTION

Present invention relates to a finish for synthetic filament yarn processed in friction-texturing, more precisely a finish applicable to various types of partially oriented yarn (POY), ranging from coarse-denier to fine-denier and from semi-dull to bright yarns, to be processed with a draw-texturing machine (DT machine) operated with a wide range of processing speed, wherein the specifically designed finish minimizes fluffs in yarn production, and fume and varnish buildup on heater surface and snow deposit in texturing process.

Recently, draw-texturing speed has been increased above 1000 m/min owing to the improved performances of DT machines, POY and finishes. And POY consisting of fine= denier monofilament, 1.0 denier or less, has been able to be produced. The improvement has urged a demand of three different finishes for fiber producers, i.e., finishes for conventional low-speed friction texturing (with contact heaters), finishes for high-speed friction texturing (with non-contact heaters) and finishes for fine denier yarn. Such demand results in complicated finish application control and there comes out a new requirement for unifying those various finishes into a single versatile finish.

For solving the problem, a finish containing a polyether produced by end-capping an ethylene-oxide-propylene-oxide adduct of polyether with alkyl groups forming ether bonds as a major component has been proposed in Japanese Patent Publication Sho-62-25789 for applying to filament yarn fed to high-speed processes. The finish containing the component enables to increase friction-texturing speed indeed, but it is not a versatile finish applicable to both filament yarn processed in high-speed friction-texturing and fine denier yarn because the above-mentioned polyether contains high ratio of propylene oxide and forms weak finish film that cannot prevent a lot of fluffs generated on fine denier yarn.

For applying to POY of fine denier monofilament to be processed in high-speed friction texturing, a finish formula containing 30 to 70% of a polyether having 1000 to 5000 molecular weight which was produced by end-capping an EO/PO adduct of a polyhydric alcohol with alkyl groups and 10 to 30% of a polyether having 7000 to 12000 molecular weight which was produced by adding EO and PO to a polyhydric alcohol, as major components, and also containing 2 to 10% of a polyether having 18000 to 28000 molecular weight which was produced by adding EO and PO to a polyhydric alcohol and 4 to 15% of branched-chain fatty acid ester having a viscosity of 2 to 5 cPs at 75° C. has been disclosed in Japanese Patent Publication Hei-7-6134.

The formula enables to texture fine denier yarn within wide range of processing speed from low to high indeed, but it is not possible to apply the formula to coarse denier yarn in addition to fine denier yarn because the formula imparts excessively low filament-to-filament static friction at normal temperature due to the high ratio of polyether having a molecular weight of 7000 or more and results in poor package buildup of coarse denier POY consisting of monofilament of 2.0 dtex or more. And the branched-chain fatty acid ester blended as a lubricant generates more stain on heater surface than polyethers or esters containing EO and PO though it generates less stain on heater surface than linear-chain fatty acid esters.

For applying to fine denier yarn processed in high-speed friction texturing, a finish formula containing 30 to 50% of a polyether having 1000 to 3000 molecular weight and 30 to 50% of a polyether having 5000 to 7000 molecular weight as major components and also containing 5 to 15% of an EO (1 to 5 moles) adduct of $C_{6-18}$ alcohol being esterified with $C_{6-18}$ fatty acid has been disclosed in Japanese Patent 3086153. The formula enables to texture fine denier yarn within wide range of processing speed from low to high, but it is not possible to apply the formula to coarse denier yarn in addition to fine denier yarn because the formula imparts excessively low filament-to-filament static friction at normal temperature due to the high ratio of polyether having 5000 to 7000 molecular weight and results in poor package buildup of coarse denier POY consisting of monofilament of 2.0 dtex or more. In addition, the compound used as a friction-decreasing agent, which was produced by esterifying an EO (1 to 5 moles) adduct of $C_{6-18}$ alcohol with $C_{6-18}$ fatty acid, has a low molecular weight and causes a fuming trouble in a process with DTY machines having low fume-exhausting performance.

SUMMARY OF THE INVENTION

The object of the present invention is to provide a finish for synthetic filament applicable to various yarns and in a wide range of texturing speed, such as low-speed friction texturing (with contact heaters), high-speed friction texturing (with non-contact heaters), coarse denier yarns and fine denier yarns.

The aim of the present invention is to provide a finish for friction-texturing applicable to various yarns and in a wide range of texturing speed with satisfactory POY package buildup and POY release from packages, minimum fluffs and loops of POY, and with minimum fluffs of DTY and minimum fume and stain on heaters in draw-texturing, the finish of which formulation has been considered to be difficult.

The inventors of the present invention have found that the above-mentioned object can be attained by combining a specific EO/PO polyether that imparts high filament-to-filament static friction at normal temperature to achieve superior cohesion and package buildup of POY and imparts low filament-to-filament static friction at high temperature to prevent fluffs or ends down in texturing process; and a specific ether ester that minimizes fume and stain on heaters and decreases the friction between filament and various contact bodies which increases with increasing texturing speed. The present invention provides a finish for synthetic filament to be friction-textured containing 50 to 85 weight percent of Component A and 10 to 30 weight percent of Component B, having the following structures, of which total ranges from 60 to 95 weight percent.

The structure of Component A is $R_1[O(C_2H_4O)x.(C_3H_6O)yH]z$, wherein $R_1$ is a trihydric or tetrahydric alcohol residue, z is an integer of 3 or 4 corresponding to the number of hydroxyl groups in $R_1$, and x and y are integers of 1 or greater attaining a weight ratio of oxytehylene group and oxypropylene group from 90:10 to 60:40 and a molecular weight of the resultant compound from 1000 to 4000.

The structure of Component B is $R_2[O(C_2H_4O)a.(C_3H_6O)b]COR_3$, wherein $R_2$ is a $C_{4-18}$ monohydric alcohol residue, $R_3$ is a $C_{7-17}$ fatty acid residue, a is an integer from 3 to 15, b is an integer from 0 to 12 and the total of a and b ranges from 6 to 15.

It is preferable to blend 0.1 to 2.0 weight percent of Component C mentioned below and/or 0.1 to 2.0 weight percent of Component D mentioned below to improve antistatic performance.

Component C is an alkyl ($R_4$) sulfonate salt, wherein $R_4$ is $C_{10-18}$ alkyl or alkenyl group.

Component D is an alkyl ($R_5$) phosphate salt or a phosphate salt of an alkylene oxide adduct of an alkyl ($R_5$) wherein $R_5$ is a $C_{8-18}$ alcohol residue.

DESCRIPTION OF PREFERRED EMBODIMENT

Component A of the present invention is further described as follows.

Component A is a random or block copolymer of polyhydric alcohol, such as trihydric or tetrahydric alcohol, and ethylene and propylene oxides. The polyhydric alcohol is glycerin, trimethylol propane, or pentaerythritol. When a monohydric or dihydric alcohol is employed as the starting material for the polyether, the molecular weight of the resultant polyether should be controlled at 4000 or more and the polyether should be blended in a great ratio in a finish formula for decreasing fluffs generated in the friction texturing of fine denier yarn. The great ratio of the polyether will decrease filament-to-filament static friction at normal temperature and lead to poor package buildup of coarse denier POY. When a polyhydric alcohol containing five or more of hydroxyl groups is employed, filament-to-filament friction will be increased and fluffs will be generated in high-speed draw-texturing.

The average molecular weight of Component A should range from 1000 to 4000, preferably 1500 to 3000. A molecular weight below the range will result in low-viscosity component that causes poor POY cohesion and loops of POY and will increase filament-to-filament static friction at high temperature that decreases fluff-preventing effect for DTY. A molecular weight above the range will result in viscous component that decreases the lubricity of the resultant finish and thus decreases the production and processing efficiency of POY and DTY.

Less than 60% of EO to the total of EO/PO in the polyether increases filament-to-filament static friction at high temperature to decrease fluff preventing effect while more than 90% of EO makes solid polyether that causes poor POY releasing performance from packages and thus causes variable POY tension.

Less than 50% of Component A in a finish formula loses the ideal performance of the finish of the present invention, i.e., attaining high filament-to-filament static friction at normal temperature and low filament-to-filament static friction at high temperature. And more than 85% of Component A decreases the ratio of the ester of alkyl ether and consequently reduces the lubricity of the resultant finish to cause poor POY releasing performance from package and increased fluffs on DTY.

Component B of the present invention is further described as follows.

When the monohydric alcohol residue, $R_2$, in the structure of Component B, has less than 4 carbon atoms, a finish formula containing Component B imparts poor lubricity to POY and DTY and increases fluffs especially in high-speed draw-texturing process. And the monohydric alcohol residue having more than 18 carbon atoms results in increased stain on heaters in draw-texturing process. Either straight-chain alcohols or branched-chain alcohols can be employed as the $C_{4-18}$ monohydric alcohol residue in Component B. The typical alcohols are 2-ethylhexyl alcohol, decyl alcohol, lauryl alcohol, $C_{12,13}$ synthetic alcohol and oreyl alcohol.

A monohydric alcohol being added with less than 6 moles of alkylene oxide generates fume because of its small molecular weight. And a monohydric alcohol being added with more than 15 moles of alkylene oxide cannot impart sufficient lubricity to POY and increases fluffs especially in high-speed draw-texturing process.

The preferable alkylene oxide is ethylene oxide or random or block copolymer of ethylene and propylene oxides.

A fatty acid having less than 8 carbon atoms reacted with the said alcohol cannot impart sufficient lubricity to POY and increases fluffs in high-speed draw-texturing process. And a fatty acid having more than 18 carbon atoms results in the increase of stain on heater surface in draw-texturing process.

The examples of the said $C_{8-18}$ fatty acid are caprylic acid, capric acid, lauric acid and oleic acid.

Less than 5% of Component B imparts insufficient lubricity and increased fluffs in high-speed draw-texturing process. And more than 30% of Component B increases stain on contact heaters of draw-texturing machines.

Component C of the present invention is further described as follows.

Component C is an antistat generating little stain on heater surface. The alkyl group ($R_4$) in the component is $C_{10-18}$ alkyl or alkenyl group. And an alkyl group having less than 10 carbon atoms results in poor compatibility to other finish components while an alkyl group having more than 18 carbon atoms increases stain on heater surface.

Component D of the present invention is further describer as follows.

Component D is also an antistat generating little stain on heater surface. The alkyl group ($R_5$) in the component is $C_{8-18}$ alcohol residue. And an alkyl group having less than 8 carbon atoms results in poor compatibility to other finish components while an alkyl group having more than 18 carbon atoms increases stain on heater surface.

Applying the aqueous solution of the finish of the present invention, of which finish concentration is 5 to 20%, to POY with finish application rolls or guides with 0.2 to 1.0% results in DTY that satisfies the object of the present invention mentioned above.

A small amount of an alkylene oxide adduct of higher alcohol or an alkylene oxide adduct of alkyl amine as a penetrating agent and a small amount of antioxidant and the like can be added to the finish of the present invention so far as the effect of the present invention is not affected.

For example, natural and synthetic $C_8$ to $C_{24}$ alcohols can be employed for the said alkylene oxide adduct of higher alcohol, and alkylene oxides produced by polymerizing 2 to 18 moles of EO and/or PO can be employed for the said adduct.

The alkyl amines applicable for the said alkylene oxide adduct of alkyl amine are octyl amine, coco amine, tallow amine and oreyl amine, and the applicable alkylene oxides are those produced by polymerizing 2 to 18 moles of EO and/or PO.

The applicable antioxidants are hindered phenols, thiodipropionates and phosphites, and an antioxidant that is completely soluble and does not yellow fiber must be selected.

EXAMPLES OF EMBODIMENT

The present invention is further described with the following examples.

The components applied to finishes of the present invention (Examples 1 to 6) and comparative finishes (Comparative Examples 1 to 9) are shown in Tables 1, 2 and 3.

TABLE 1

| | Polyethers | | |
|---|---|---|---|
| | Starting material | EO/PO weight ratio | Molecular weight |
| A | Glycerin | 85:15 | 1600 |
| B | Glycerin | 70:30 | 2500 |
| C | Trimethylol propane | 80:20 | 2300 |

TABLE 1-continued

| | Polyethers | | |
|---|---|---|---|
| | Starting material | EO/PO weight ratio | Molecular weight |
| D | Pentaerythritol | 60:40 | 2800 |
| E | Trimethylol propane | 30:70 | 2500 |
| F | Diethylene glycol | 70:30 | 4100 |
| F' | Diethylene glycol | 30:70 | 2500 |
| F" | Diethylene glycol | 65:35 | 6500 |
| G | Glycerin | 70:30 | 800 |

TABLE 2

| | Esters | | |
|---|---|---|---|
| | Alcohols | EO/PO (mole ratio) | Fatty acid |
| H | 2-ethylhexanol | 6:2 | Capric acid |
| I | Lauryl alcohol | 2:7 | Caprylic acid |
| J | $C_{12,13}$ synthetic alcohol | 8:3 | Lauric acid |
| K | Lauryl alcohol | 10:0 | Capric acid |
| K' | Lauryl alcohol | 4:0 | Caprylic acid |
| L | Decyl alcohol | 8:0 | Palmitic acid |
| M | 2-ethyihexanol | 2:1 | Lauric acid |
| N | Lauryl alcohol | 15:5 | Caprylic acid |
| O | Oreyl alcohol | 6:2 | Erucic acid |

TABLE 3

| | Antistat and Other Components |
|---|---|
| P | POE(9) $C_{12,13}$ synthetic alcohol |
| P' | POE(7) secondary alcohol |
| Q | EO/PO (10 mole:5 mole) synthetic alcohol |
| R | Sodium $C_{14-16}$ alkyl sulfonate |
| R' | Sodium lauryl sulfonate |
| S | POE(5) lauryl phosphate TEA salt |
| S' | Potassium lauryl phosphate |

Preparation of POY (155 dtex/36 f)

Each of the finishes shown in Table 4 was made into 10-% aqueous solution. Undrawn yarn (155 dtex/36 f) of polyethylene terephthalate having 0.63 intrinsic viscosity was melt-spun at 3300 m/min spinning speed and applied with the finishes shown in Table 4 with 0.35 weight percent to undrawn yarn weight with a finish application roll.

Then the prepared POY was draw-textured with a draw-texturing machine, HTS-15, produced by Teijin Seiki, at 1100 m/min processing speed with 1.86 draw ratio and with a non-contact first heater controlled at 500° C. and urethane discs.

Preparation of POY (121 dtex/144 f)

Each of the finishes shown in Table 5 was prepared into 10-% aqueous solution. Undrawn yarn (121 dtex/144 f) of polyethylene terephthalate having 0.63 intrinsic viscosity was melt-spun at 3000 m/min spinning speed and applied with the finishes shown in Table 5 with 0.50 weight percent to undrawn yarn weight with a finish application roll.

Then the prepared POY was draw-textured with a draw-texturing machine, FK-6, produced by Barmag, at 700 m/min processing speed with 1.49 draw ratio and with a first contact heater controlled at 185° C. and urethane discs.

a. POY package buildup

The cross yarn and bulge of full packages of POY were visually inspected.

○: none Δ: a little X: a lot b. Fluffs and loops of POY

The fluffs and loops on the surface of full packages of POY were counted.

○: below 5 Δ: 5 to below 10 X: 10 or more c. POY release from packages

The maximum tension of POY being released from packages at 1500 m/min yarn speed was detected with a package analyzer produced by Toray.

○: below 1.3 cN Δ: 1.3 cN to below 1.7 cN X: 1.7 cN or more d. Fluffs of DTY

The fluffs on 10,000 m of DTY before take-up in draw-texturing operation were counted with a fluff tester, DT-104, produced by Toray.

○: below 10 Δ: 10 to below 30 X: 30 or more e. Fume in draw-texturing process

The fume generated on the first heater in the draw-texturing operation with FK-6, produced by Barmag, was visually inspected.

○: almost none Δ: a little X: a lot f. Stain on heater in draw-texturing process The stain on first heater surface after 300 hours of continuous draw-texturing operation was visually inspected.

○: almost no stain Δ: a little stain X: a lot of stain

TABLE 4

| POY 155dtex/36f, HTS-15V by Teijin Seiki, 1100 m/min yarn speed | | | | | | | | | | | | | | | |
|---|---|---|---|---|---|---|---|---|---|---|---|---|---|---|---|
| Ratio of | Examples | | | | | | Comparative Examples | | | | | | | | |
| component | 1 | 2 | 3 | 4 | 5 | 6 | 1 | 2 | 3 | 4 | 5 | 6 | 7 | 8 | 9 |
| A | 70 | | | | 30 | | 45 | | | | 88 | | | | |
| B | | 80 | | | | 70 | | | | | | | | | |
| C | | | 60 | | 40 | | | | | | | 63 | 63 | 63 | |
| D | | | | 50 | | | | | | | | | | | |
| E | | | | | | | | 70 | | | | | | | |
| F | | | | | | | | | | 70 | | | | | |
| F' | | | | | | | | | | | | | | | 30 |
| F" | | | | | | | | | | | | | | | 40 |
| G | | | | 15 | | | | | 70 | | | | | | |
| H | 20 | | | | 20 | | 45 | 20 | 20 | 20 | 2 | | | | |
| I | | 15 | | | | 10 | | | | | | | | | |
| J | | | | 20 | | | | | | | | | | | |
| K | | | 25 | | | | | | | | | | | | |
| K' | | | | | | | | | | | | | 10 | | |
| L | | | | | | 10 | | | | | | | | | |

TABLE 4-continued

POY 155dtex/36f, HTS-15V by Teijin Seiki, 1100 m/min yarn speed

| Ratio of | Examples | | | | | | Comparative Examples | | | | | | | | |
|---|---|---|---|---|---|---|---|---|---|---|---|---|---|---|---|
| component | 1 | 2 | 3 | 4 | 5 | 6 | 1 | 2 | 3 | 4 | 5 | 6 | 7 | 8 | 9 |
| M | | | | | | | | | | | | 25 | | | |
| N | | | | | | | | | | | | | 25 | | |
| O | | | | | | | | | | | | | | 25 | |
| P | | | 10 | 8 | | 8 | | | | | | 10 | 10 | 10 | |
| P' | | | | | | | | | | | | | | | 10 |
| Q | 8 | 3 | 3 | 5 | 8 | | 8 | 8 | 8 | 8 | 8 | | | | |
| R | 1 | 1 | 1 | 1 | 1 | 1 | 1 | 1 | 1 | 1 | 1 | 1 | 1 | 1 | |
| R' | | | | | | | | | | | | | | | 0.5 |
| S | 1 | 1 | 1 | 1 | 1 | 1 | 1 | 1 | 1 | 1 | 1 | 1 | 1 | 1 | |
| S' | | | | | | | | | | | | | | | 0.5 |
| a | ○ | ○ | ○ | ○ | ○ | ○ | ○ | ○ | ○ | X | ○ | ○ | ○ | ○ | X |
| b | ○ | ○ | ○ | ○ | ○ | ○ | Δ | ○ | Δ | ○ | ○ | ○ | ○ | ○ | ○ |
| c | ○ | ○ | ○ | ○ | ○ | ○ | ○ | ○ | ○ | X | Δ | ○ | Δ | ○ | X |
| d | ○ | ○ | ○ | ○ | ○ | ○ | Δ | Δ | Δ | ○ | Δ | ○ | X | ○ | ○ |
| e | ○ | ○ | ○ | ○ | ○ | ○ | Δ | ○ | ○ | ○ | ○ | Δ | ○ | ○ | Δ |
| f | ○ | ○ | ○ | ○ | ○ | ○ | Δ | ○ | ○ | ○ | ○ | ○ | ○ | Δ | ○ |

a POY package buildup
b Fluffs and loops of POY
c POY release from packages
d Fluffs of DTY
e Fume in draw-texturing process
f Stain on heater in draw-texturing process

TABLE 5

POY 121dtex/144f, FK-6 by Barmag, 700 m/min yarn speed

| Ratio of | Examples | | | | | | Comparative Examples | | | | | | | | |
|---|---|---|---|---|---|---|---|---|---|---|---|---|---|---|---|
| component | 7 | 8 | 9 | 10 | 11 | 12 | 10 | 11 | 12 | 13 | 14 | 15 | 16 | 17 | 18 |
| A | 70 | | | | 30 | | 45 | | | | 88 | | | | |
| B | | 80 | | | | 70 | | | | | | | | | |
| C | | | 60 | | 40 | | | | | | | 63 | 63 | 63 | |
| D | | | | 50 | | | | | | | | | | | |
| E | | | | | | | | 70 | | | | | | | |
| F | | | | | | | | | | 70 | | | | | |
| F' | | | | | | | | | | | | | | | 30 |
| F" | | | | | | | | | | | | | | | 40 |
| G | | | | 15 | | | | | 70 | | | | | | |
| H | 20 | | | | 20 | | 45 | 20 | 20 | 20 | 2 | | | | |
| I | | 15 | | | | 10 | | | | | | | | | |
| J | | | | 20 | | | | | | | | | | | |
| K | | | 25 | | | | | | | | | | | | |
| K' | | | | | | | | | | | | | | | 10 |
| L | | | | | | 10 | | | | | | | | | |
| M | | | | | | | | | | | | 25 | | | |
| N | | | | | | | | | | | | | 25 | | |
| O | | | | | | | | | | | | | | 25 | |
| P | | | 10 | 8 | | 8 | | | | | | 10 | 10 | 10 | |
| P' | | | | | | | | | | | | | | | 10 |
| Q | 8 | 3 | 3 | 5 | 8 | | 8 | 8 | 8 | 8 | 8 | | | | |
| R | 1 | 1 | 1 | 1 | 1 | 1 | 1 | 1 | 1 | 1 | 1 | 1 | 1 | 1 | |
| R' | | | | | | | | | | | | | | | 0.5 |
| S | 1 | 1 | 1 | 1 | 1 | 1 | 1 | 1 | 1 | 1 | 1 | 1 | 1 | 1 | |
| S' | | | | | | | | | | | | | | | 0.5 |
| a | ○ | ○ | ○ | ○ | ○ | ○ | ○ | ○ | ○ | ○ | ○ | ○ | ○ | ○ | ○ |
| b | ○ | ○ | ○ | ○ | ○ | ○ | Δ | Δ | X | ○ | ○ | ○ | Δ | ○ | ○ |
| c | ○ | ○ | ○ | ○ | ○ | ○ | ○ | ○ | ○ | ○ | Δ | ○ | Δ | ○ | ○ |
| d | ○ | ○ | ○ | ○ | ○ | ○ | X | X | X | ○ | Δ | ○ | Δ | ○ | ○ |
| e | ○ | ○ | ○ | ○ | ○ | ○ | Δ | ○ | ○ | ○ | ○ | X | ○ | ○ | Δ |
| f | ○ | ○ | ○ | ○ | ○ | ○ | X | ○ | ○ | ○ | ○ | ○ | ○ | X | ○ |

a POY package buildup
b Fluffs and loops of POY
c POY release from packages
d Fluffs of DTY
e Fume in draw-texturing process
f Stain on heater in draw-texturing process In the production and draw-texturing processes of POY of 155 dtex/36 f, the finishes of Examples 1 to 6 of the present invention exhibited superior performance while the finishes of Comparative Examples 1 to 9 caused following troubles.

The finish of Comparative Example 1 in which less than 50% of the polyether of the present invention and more than 30% of the ester of the present invention were blended caused loops of POY In addition, it caused a lot of fluffs of DTY, and fume and stain on heater surface.

The finish of Comparative Example 2 in which a polyether containing less EO than that in the polyether of the present invention was blended caused a lot of fluffs of DTY.

The finish of Comparative Example 3 in which a polyether of smaller molecular weight than that of the polyether of the present invention was blended caused fluffs and loops of POY and a lot of fluffs of DTY.

The finish of Comparative Example 4 in which a polyether produced from a diol as a starting material being different from the polyether of the present invention was blended caused remarkably poor package buildup and releasing performance of POY.

The finish of Comparative Example 5 in which a polyether was blended in higher ratio than that of the finish of the present invention caused poor releasing performance of POY and a lot of fluffs of DTY because of low ratio of ester.

The finish of Comparative Example 6 in which an ester added with less EO/PO than that of the ester in the finish of the present invention was blended caused a lot of fume in draw-texturing process.

The finish of Comparative Example 7 in which an ester added with more EO/PO than that of the ester in the finish of the present invention was blended caused poor releasing performance of POY and a lot of fluffs of DTY.

The finish of Comparative Example 8 in which an ester having longer alkyl chain than that of the ester in the finish of the present invention was blended caused a lot of stain on heater surface in draw-texturing process.

The finish of Comparative Example 9 in which a polyether produced from a diol as a starting material and having a molecular weight more than 4000, being different from the polyether of the present invention, was blended caused remarkably poor package buildup and releasing performance of POY.

In the production and draw-texturing processes of POY of 121 dtex/144 f being applied with the same finishes as those applied to the POY of 155 dtex/36 f mentioned above, the finishes of Examples 7 to 12 of the present invention caused no problems while the finishes of Comparative Examples 10 to 12 and 14 to 18 caused following troubles.

Comparative Example 10: fluffs and loops of POY, fluffs of DTY, and fume and stain on heater surface in draw-texturing process Comparative Example 11: fluffs and loops of POY, and fluffs of DTY Comparative Example 12: fluffs and loops of POY, and fluffs of DTY Comparative Example 14: poor releasing performance of POY and fluffs of DTY Comparative Example 15: fume in draw-texturing process Comparative Example 16: poor releasing performance, fluffs and loops of POY, and fluffs of DTY Comparative Example 17: stain on heater surface in draw-texturing process Comparative Example 18: fume in draw-texturing process As described above, the finish of the present invention can achieve superior cohesion and package buildup of POY of even coarse denier monofilament and also prevent fluffs or ends down of POY of fine denier monofilament in texturing process owing to its major component, a polyether of polyhydric alcohol and EO/PO copolymer having a molecular weight of 1000 to 4000. In addition, the special ether-ester blended in the finish enables to decrease friction of POY without increasing fume and stain on heater surface and thus the finish of the present invention can be applied to POY processed in a wide range of yarn speed from low to high.

We claim:

1. A finish for synthetic filament yarn processed in friction texturing wherein 50 to 85 weight percent of Component A having the following structure and 10 to 30 weight percent of Component B having the following structure are contained and the total of those components ranges from 60 to 95 weight percent:

Component A having the structure, $R_1[O(C_2H_4O)x.(C_3H_6O)yH]z$, wherein $R_1$ is a trihydric or tetrahydric alcohol residue, z is an integer of 3 or 4 corresponding to the number of hydroxyl groups in $R_1$, and x and y are integers of 1 or greater attaining a weight ratio of oxytehylene group ($C_2H_4O$) and oxypropylene group ($C_3H_6O$) from 90:10 to 60:40 and a molecular weight of the resultant component from 1000 to 4000; and Component B having the structure, $R_2[O(C_2H_4O)a.(C_3H_6O)b]COR_3$, wherein $R_2$ is a $C_{4-18}$ monohydric alcohol residue, $R_3$ is a $C_{7-17}$ fatty acid residue, a is an integer from 3 to 15, b is an integer from 0 to 12 and the total of a and b ranges from 6 to 15.

2. A finish for synthetic filament yarn processed in friction texturing wherein 50 to 85 weight percent of Component A having the following structure and 10 to 30 weight percent of Component B having the following structure are contained, the total of those components ranges from 60 to 95 weight percent, and 0.1 to 2.0 weight percent of Component C and/or 0.1 to 2.0 weight percent of Component D are contained:

Component A having the structure, $R_1[O(C_2H_4O)x.(C_3H_6O)yH]z$, wherein $R_1$ is a trihydric or tetrahydric alcohol residue, z is an integer of 3 or 4 corresponding to the number of hydroxyl groups in $R_1$, and x and y are integers of 1 or greater attaining a weight ratio of oxytehylene group ($C_2H_4O$) and oxypropylene group ($C_3H_6O$) from 90:10 to 60:40 and a molecular weight of the resultant component from 1000 to 4000;

Component B having the structure, $R_2[O(C_2H_4O)a.(C_3H_6O)b]COR_3$, wherein $R_2$ is a $C_{4-18}$ monohydric alcohol residue, $R_3$ is a $C_{7-17}$ fatty acid residue, a is an integer from 3 to 15, b is an integer from 0 to 12 and the total of a and b ranges from 6 to 15;

Component C being an alkyl ($R_4$) sulfonate salt, wherein $R_4$ is a $C_{10-18}$ alkyl or $C_{10-18}$ alkenyl group; and Component D being an alkyl ($R_5$) phosphate salt or a phosphate salt of an alkylene oxide adduct of alkyl ($R_5$), wherein $R_5$ is a $C_{8-18}$ alcohol residue.

* * * * *